US005704429A

United States Patent [19]

Lee et al.

[11] Patent Number: 5,704,429

[45] Date of Patent: Jan. 6, 1998

[54] CONTROL SYSTEM OF AN EXCAVATOR

[75] Inventors: Jin Han Lee; Jeong Chul Lee, both of Changwon, Rep. of Korea

[73] Assignee: Samsung Heavy Industries Co., Ltd., Rep. of Korea

[21] Appl. No.: 762,990

[22] Filed: Dec. 10, 1996

[30] Foreign Application Priority Data

Mar. 30, 1996 [KR] Rep. of Korea ..... 96-9637
Apr. 30, 1996 [KR] Rep. of Korea ..... 96-13962

[51] Int. Cl.[6] ..... E02F 3/32

[52] U.S. Cl. ..... 172/4.5; 37/348; 414/699; 364/424.07

[58] Field of Search ..... 37/347, 348, 382, 37/383; 172/2, 3, 4, 4.5, 7, 9, 10, 11; 364/424.06, 424.07, 424.1; 414/694, 699, 379

[56] References Cited

U.S. PATENT DOCUMENTS 4,888,890 12/1989 Studebaker et al. ..... 37/348
5,160,239 11/1992 Allen et al. ..... 172/4.5 X
5,356,259 10/1994 Hanamoto et al. ..... 37/348 X

*Primary Examiner*—Terry Lee Melius
*Assistant Examiner*—Robert Pezzuto
*Attorney, Agent, or Firm*—Harness, Dickey & Pierce, P.L.C.

[57] ABSTRACT

A control system of an excavator. The excavator includes a lower running body, an upper pivoting body, a working device having a plurality of links attached to the upper pivoting body, a pivoting device, and a running device, actuators for actuating the working device, the pivoting device, and the running device, hydraulic control valves for controlling quantities of hydraulic fluid supplied to the actuators, sensors for detecting relative angular positions of the links, and a control system. The control system includes a pair of manipulating devices each of which can be manipulated in at least three directions so as to output electrical signals proportional to deviated amounts in selected directions among the directions from a neutral position thereof, a switch board on which a plurality of function switch are installed, for outputting a signal in accordance with a selected function and displaying the selected function, a control section for controlling quantifies of hydraulic fluid supplied to the hydraulic cylinders and the hydraulic motors by receiving signals from the manipulating device, the switch board, and the angle detecting sensors and transferring the signals to the hydraulic control valves.

16 Claims, 3 Drawing Sheets

CONTROL SYSTEM OF AN EXCAVATOR

BACKGROUND OF THE INVENTION

1. Field of the Invention

The present invention relates to a control system of an excavator, and more particularly to a control system of an excavator which can easily manipulate a working device of the excavator by providing direct controlling relations between the working device and manipulating devices so that operations of the working device can be logically interconnected with the operations of the manipulating devices.

2. Description of the Prior Art

Conventionally, an excavator includes a working device which comprises a plurality of links, a pivoting device, and uses manipulating devices having several levers or pedals in order to manipulate the excavator.

However, in a conventional excavator, since the logical relations between the manipulating devices and working devices are not clear, an unskilled worker cannot easily accomplish works such as levelling works which need high-level operational skills. Further, much time and effort is needed to be accustomed to the high-level operational skills. In addition, work efficiency is lowered due to worker's fatigues and stresses during the manipulation of the excavator, even for a skilled worker.

In order to overcome the above-mentioned disadvantages, devices for determining the position of links and pivot points using miniature models are disclosed in U.S. Pat. No. 4,059,196, Japanese Patent Laid Open No. 87-33944, Japanese Patent Laid Open No. 93-257551. However, in excavators using the devices, it is necessary to determine the position continuously during work, in order to operate excavators, and the structures of the devices are complex.

Further, excavators which enable intuitional manipulations by installing manipulating devices in horizontal planes which directions are the same as those of planes on which the excavators are laid, in stead of installing the devices in vertical planes, are disclosed in Japanese Patent Publication No. 83-22613, Japanese Patent Laid Open No. 84-131066, U.S. Pat. No. 5,160,239, U.S. Pat. No. 5,424,623, EP03616666A1, Japanese Utility Model Laid Open No. 92-134570, and Japanese Patent Laid Open No. 91-275819. Nevertheless, the excavators have disadvantages in that they has no sufficient solutions to prevent safety accidents during work, and pivoting and running manipulations are still difficult.

On the other hand, excavators in which manipulating modes of excavators are different from one another, and in which a user can select a wanted manipulating mode is disclosed in Japanese Patent Laid Open No. 93-156665, Japanese Patent Laid Open No. 89-31153, and Japanese Patent Laid Open No. 92-30034. But, in the excavators, only few correlations between working devices and working devices are considered, so a great effort is needed to be skilled in the manipulating modes by a user.

SUMMARY OF THE INVENTION

Therefore, it is an object of the present invention to provide a control system of an excavator in which a working device of several links, a running device, and a pivoting device can be easily manipulated with hands.

It is another object of the present invention to provide a control system of an excavator which can easily manipulate a working device with multi-degree of freedom by providing direct controlling relations between the working device and manipulating devices so that operations the working device can be logically interconnected with the operations of the manipulating devices.

It is another object of the present invention to provide a control system of an excavator in which a user can be easily accustomed to the manipulating techniques by easily selecting needed functions of the excavator.

In order to achieve the above-mentioned objects of the present invention, there is provided an excavator comprising: a working device having a plurality of links comprising a boom attached to a tip of an upper pivoting body pivoting with respect to a lower running body, an arm attached to a tip of the boom, and a bucket attached to a tip of an arm; a pivoting device for driving and pivoting the upper pivoting body with respect to the lower running body; a running device for driving left and right chain belts of the lower running body; hydraulic cylinders and hydraulic motors for actuating the working device, the pivoting device, and the running device; hydraulic control valves for controlling quantities of hydraulic fluid supplied to the hydraulic cylinders and the hydraulic motors; a boom angle detecting sensor installed between the upper pivoting body and the boom, for detecting a relative angular position of the boom with respect to the upper pivoting body; an arm angle detecting sensor installed between the boom and the arm, for detecting the relative angular position with respect to the boom, a bucket angle detecting sensor installed between the boom and the bucket, for detecting the relative angular position with respect to the arm; a control system having a pair of manipulating devices each of which can be manipulated in at least three directions so as to output electrical signals proportional to deviated amounts in selected directions among the directions from a neutral position thereof, a switch board on which a plurality of function switch are installed, for transferring a signal in accordance with a selected function and displaying the selected function, a control section for controlling quantities of hydraulic fluid supplied to the hydraulic cylinders and the hydraulic motors by receiving signals from the manipulating device, the switch board, and the angle detecting sensors and transferring the signals to the hydraulic control valves.

According to the first aspect of the present invention, the pair of manipulating devices are a first manipulating device installed on a vertical manipulating plane, for driving the working device in accordance with a manipulating direction and an amount thereof and a second manipulating device installed on a horizontal manipulating plane, for driving the running device and the pivoting device in accordance with a manipulating direction and an amount thereof, the vertical manipulating plane having a same direction as a direction of a working plane of the working device.

According to the second aspect of the present invention, the first manipulating device is manipulated in a first manipulating direction which is a first coordinate axis, in a second manipulating direction which is a second coordinate axis, and in a third manipulating direction which is a rotating direction about a third coordinate direction perpendicular to a plane formed by the first and second coordinate axes.

According to the third aspect of the present invention, the second manipulating device is manipulated in a first manipulating direction which is a first coordinate axis, in a second manipulating direction which is a second coordinate axis, and in a third manipulating direction which is a rotating direction about a third coordinate direction perpendicular to a plane formed by the first and second coordinate axes, the manipulating directions being respectively corresponding to a forward or rearward running operation of the running device, a left or right turning operation of the running device, and a left or right pivoting operation of the pivoting device.

According to the fourth aspect of the present invention, a pivot safety switch is installed on an outer surface of the second manipulating device so as to send a signal about the third manipulation direction of the second manipulating device when the switch is on.

According to the fifth aspect of the present invention further comprises a pivot detecting sensor installed between the upper pivoting body and the lower running body, for detecting the relative angle of the upper pivoting body with respect to the lower body and transferring an angle signal to the control section.

According to the sixth aspect of the present invention, forward and rear movement of the lower running body is controlled so as to coincide with the first manipulating direction of the second manipulating device in accordance with whether the relative angle of the upper pivoting body with respect to the lower running body detected by the pivot detecting sensor is above 180 degree or not.

According to the seventh aspect of the present invention, a levelling switch for determining whether working ground surface should be levelled or not, a bucket angle switch for determining whether the absolute bucket angle should be maintained uniformly or not during the work, an ground angle switch for determining the inclined angle of the working surface during the levelling work, a mode conversion switch for converting the operational mode to a manual mode or an automatic mode are installed on the switch board, the switch board being provided with a display section for displaying information about operational states and modes of the excavator.

According to the eighth aspect of the present invention, in case of the manual mode, operations of the boom, the arm, and the bucket are respectively controlled by the first, second, and third manipulating directions.

According to the ninth aspect of the present invention, in case of the automatic mode, a pivot point of the bucket is determined by the first and second manipulating directions and manipulated amounts in the directions, and the bucket is manipulated by the third manipulating direction and manipulated amount.

According to the tenth aspect of the present invention, further comprises a bucket selection switch installed on an outer surface of the first manipulating device, for transferring a signal to the control section about manipulated directions along the direction, and the manipulated amounts of the first manipulating device while the switch is on.

According to the eleventh aspect of the present invention, when the bucket angle switch is selected during the automatic mode operation, the absolute bucket angle is uniformly maintained by manipulating the relative bucket angle with respect to the arm, and during the operation of the bucket, the bucket is manipulated regardless of the other manipulations so that the absolute bucket angle is reset to a new value.

According to the twelfth aspect of the present invention, if the levelling switch is selected, the automatic mode is automatically selected, and a position of a bucket tip is determined by the first and second direction manipulation and manipulated amounts of the first manipulating device in the automatic mode, in accordance with the detected relative boom angle with respect to the upper pivoting body, the detected relative arm angle with respect to the arm, and the detected relative bucket angle with respect to the arm, the bucket being manipulated by the third manipulating direction and amount in the direction.

According to the thirteenth aspect of the present invention, if both the levelling switch and the bucket angle switch are selected, the position of the bucket is determined and controlled by the manipulated direction and amount in the automatic mode of the first manipulating device, and then if a signal in accordance with the third manipulating direction is transferred to the manipulating device, the bucket is manipulated regardless of the other manipulations, and then if a bucket operational signal is not transferred to the manipulating device, the absolute bucket angle is maintained uniformly.

According to the fourteenth aspect of the present invention, the excavator further comprises a switch installed on a tip of the first manipulating device and connected to the control device, for controlling a point determined by the first manipulating direction and amount while the switch is on, so that the point is moved on a plane selected by the switch.

According to the fifteenth aspect of the present invention, if the switch is on during the levelling work, the bucket tip determined by directions and amounts of the first and second manipulating direction is moved in a working plane having a certain angle selected by the ground angle switch.

BRIEF DESCRIPTION OF THE DRAWINGS

The above objects and other advantages of the present invention will become more apparent by describing in detail a preferred embodiment thereof with reference to the attached drawings, in which.

DETAILED DESCRIPTION OF THE PREFERRED EMBODIMENT

Hereinafter, a preferred embodiment of the present invention will be described in detail with reference to the accompanying drawings.

Figure 1:
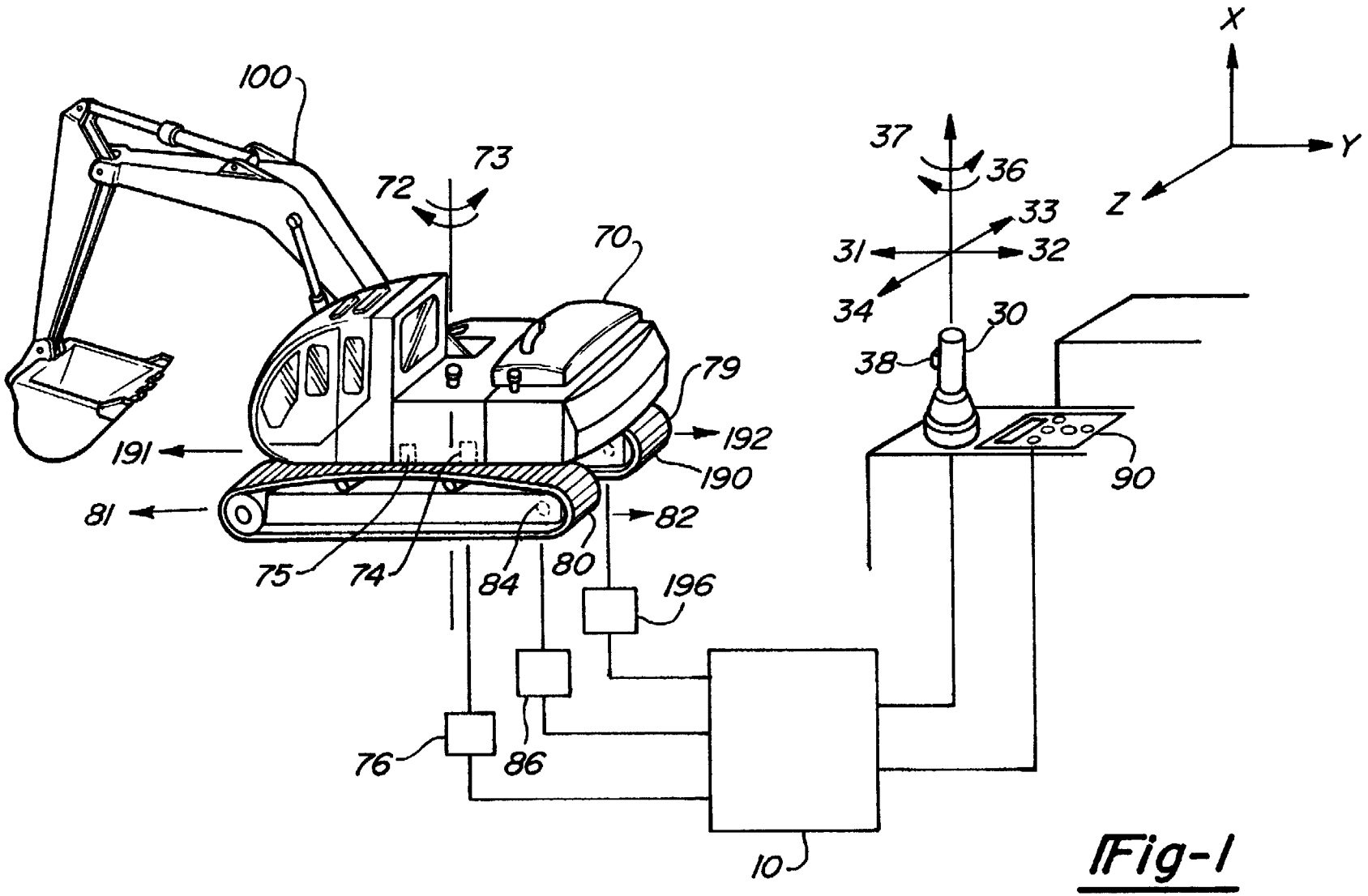
FIG. 1 is a perspective view for showing an excavator according to an embodiment of the present invention, and particularly for showing a control system of a pivoting device and a running device of the excavator.
Figure 2:
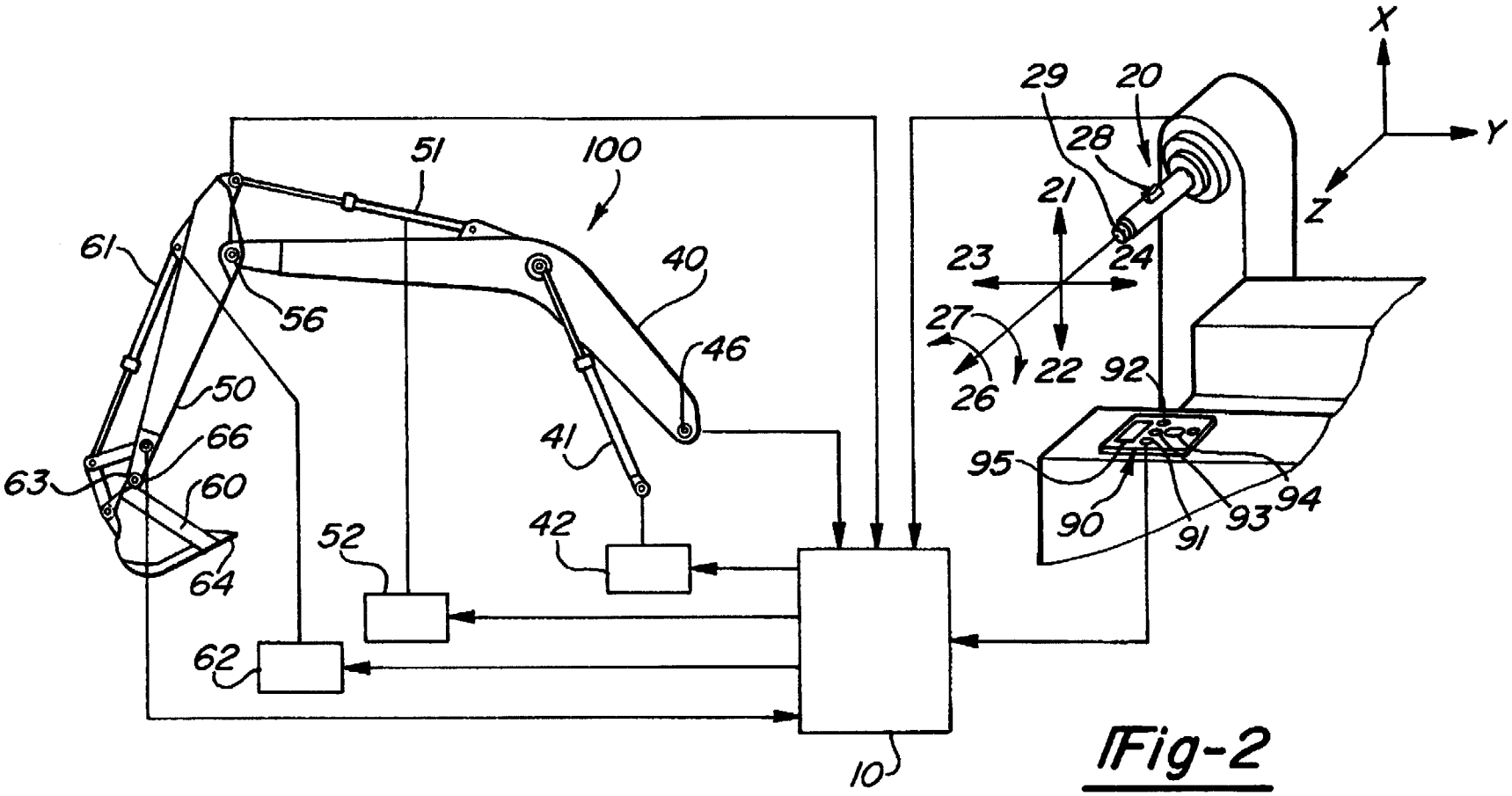
FIG. 2 is a perspective view for showing a control system of a working device of the excavator of FIG. 1.
Figure 3:
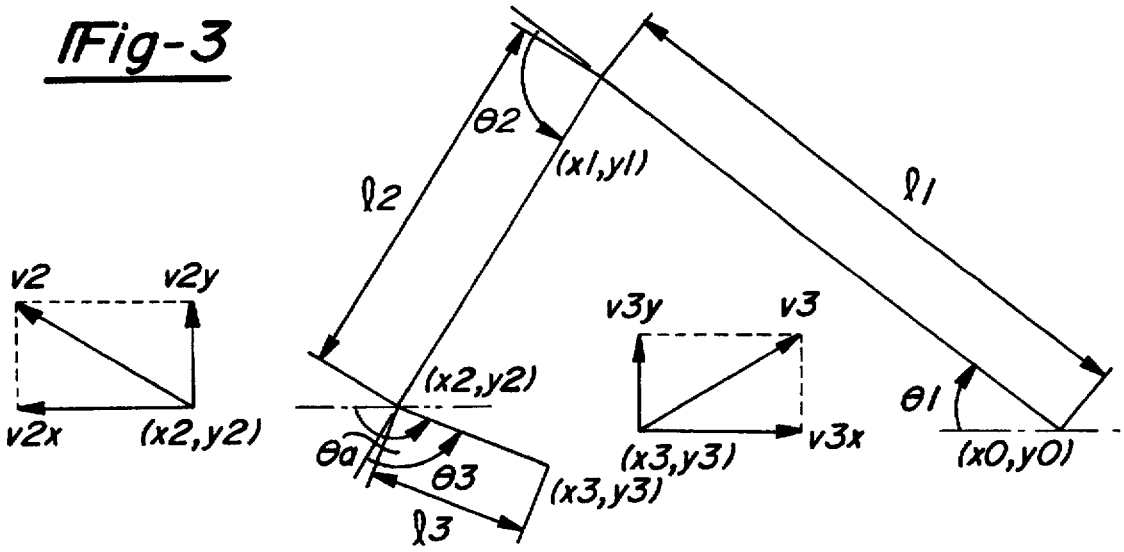
FIG. 3 is a perspective view for showing positions of pivot points of the working device of FIG. 2.

FIG. 1 schematically shows a control system of a pivoting device and a running device of an excavator according to an embodiment of the present invention, and FIGS. 2 and 3 schematically shows a control system of a working device of the excavator of FIG. 1.

As shown in FIGS. 1 and 2, the excavator is provided with a working device 100. The working device 100 comprises a boom 40, an arm 40, and a bucket 60. The boom 40 is connected to the pivoting body 70 of the excavator at one end thereof, and to one end of the arm 50 at the other end thereof. The bucket 60 is a working tool of the excavator and is connected to an end of the arm 50.

The excavator comprises a lower running body 79, an upper pivoting body 70, and a working device 100. The upper pivoting body 70 is pivotally mounted on the lower running body 79. The working device 100 is mounted on the upper pivoting body 70 at the front portion of the upper pivoting body 70, and has a plurality of joints so that the angular positions of the links such as the boom 40 and the arm 50 can be varied.

The working device 100 moves in a two dimensional plane as either the boom 40 or the upper pivoting body 70 is pivoted.

The boom 40 is operated by a hydraulic cylinder 41 and moves the working device 100 upward and downward. The arm 50 is also operated by a hydraulic cylinder 51 and moves the bucket 60 towards and away from the pivoting body 70. The angular position of the bucket 60 is varied when it is operated by a hydraulic cylinder 61 so as to accomplish its excavating operation.

A boom angle detecting sensor 46 for detecting the relative angular position of the boom 40 with respect to the upper pivoting body 70, an arm angle detecting sensor 56 for detecting the relative angular position of the arm 50 with respect to the boom 40, and a bucket angle detecting sensor 66 for detecting the relative angular position of the bucket 60 with respect to the arm 50 are respectively installed between the boom 40 and the upper pivoting body 70, between the boom 40 and the arm 50, and between the arm 50 and the bucket 60.

The quantities of hydraulic fluid supplied to the hydraulic cylinders 41, 51, and 61 are controlled by hydraulic control valves 42, 52, and 62 respectively. Further, the quantities of hydraulic fluid supplied to the hydraulic motors 74, 84, and 194 are controlled respectively by hydraulic control valves 76, 86, and 196 during the pivoting and running operations of the excavator. The hydraulic control valves 42, 52, 62, 76, 86, and 196 are connected to the control section 10 which is connected to a switch board 90 and first and second manipulating devices 20 and 30.

A pivoting motor 74 drives the upper pivoting body 70 of the excavator, and left and right running motors 194 and 84 turn the excavator left and right respectively.

The first and second manipulating devices 20 and 30 are respectively installed at positions to the left and right of a user, and vice versa, in front of the user, and move in three dimensional ways.

The first manipulating device 20, as shown in FIG. 2, has three manipulating directions, i.e., a first manipulating direction 21 and 22 which is the X coordinate direction, a second manipulating direction 23 and 24 which is the Y coordinate direction, and a third manipulating direction 26 and 27 which is the rotating direction about the Z coordinate direction perpendicular to the plane formed by the X and Y coordinate axes.

On the other hand, as shown in FIG. 2, the second manipulating device 30, has three manipulating directions, i.e., a first manipulating direction 31 and 32 which is the Y coordinate direction, a second manipulating direction 33 and 34 which is the Z coordinate direction, and a third manipulating direction 36 and 37 which is the rotating direction about the X coordinate direction perpendicular to the plane formed by the Y and Z coordinate axes.

The first and second manipulating devices 20 and 30 generate signals which are proportional to the amounts of deviation from their neutral positions when they are manipulated. The signals are transferred to the control section 10 when the switch board 90 is manipulated.

The switch board 90 is provided with a plurality of function switches which enable the selection of operational functions already programmed, and hence a user can select wanted functions to be transferred to the control section 10 in order to accomplish the functions.

Installed on the switch board 90 are a display section 95 for displaying various information about the operation of the excavator such as operational states and operational modes, a mode conversion switch 91 for converting the operational mode to manual or automatic modes, a levelling switch 92 which is used in case of the levelling of the inclined ground surfaces, a bucket angle switch 94 for detecting the absolute angle of the bucket 60 during the work, and a ground angle switch 93 for detecting the inclined angle of the ground during the levelling of the ground surfaces.

A potentiometer, an up-down switch, or the like can used as the ground angle switch 93 to enable the continuous detection of the ground angle.

Each of the first and second manipulating devices 20 and 30 is provided with a bucket selection switch 28 and a pivot selection switch 38 on the outer surfaces of their levers, so that the manipulating devices 20 and 30 can be manipulated in their manipulating directions 20 and 30 only when the switches 28 and 38 are on.

The control section 10 receives signals from the switch board 90, manipulating devices 20 and 30, and angle detecting sensors 46, 56, and 66, and transfers control signals to the hydraulic control valves 42, 52, 62, 76, 86, and 196. The hydraulic control valves 42, 52, 62, 76, 86, and 196 controls the movements of the working device 100, pivoting body 70, and running body 79 by controlling the quantities of hydraulic fluids supplied to the hydraulic cylinders 41, 51, and 61 and the hydraulic motors 174, 84, and 194.

Hereinafter, the operation of the control system relevant to the working device 100 will explained with reference to FIG. 2.

The relations between the first manipulating device 20 and the working device, when the mode conversion switch is converted to the manual mode, are as follows.

| | first manipulating direction | | second manipulating direction | | third manipulating direction | |
|---|---|---|---|---|---|---|
| direction of the manipulating device | upward | down-ward | forward | rear-ward | counter clockwise | clock wise |
| operation of the working device | boom up | boom down | arm stretch-ing | arm con-tracting | bucket closed | bucket open |

In case of the manual mode, since the direction of the manipulating plane of the first manipulating device 20 is the same as the direction of the operational plane of the working device 100, the logical operational relations between the first manipulating device 20 and the working device 100 can be easily recognized by a user, thereby enabling intuitional control of the excavator.

On the other hand, if the automatic mode is selected, the relative angular positions of the boom 40 and the arm 50 are controlled by the control section 10 so that the position of a pivot point 63 can be determined by a combined direction with the first and second manipulating directions 21, 22, 23, and 24 of the first manipulating device 20 and by the manipulating amount along the directions. Then, the manipulating direction and the manipulating amount are inputted to the control section 10, and the relative angles of the boom 40 and the arm 50 are determined by the control section 10 and are outputted therefrom. Preferably, the relative angular positions of the boom 40 and the arm 50 are detected by the angle detecting sensors 46, 56, and 66, and then are inputted to the control section 10. A resolver, a potentiometer, and an encoder or the like can be used as the angle detecting sensors 46, 56, and 66.

The bucket 60 is manipulated by the third direction of the first manipulating device 20. The signals from the bucket 60 are processed in the control section 10 only when the bucket safety switch is on to prevent unintended operations while manipulating the first manipulating device 20, so that the bucket 60 is manipulated only by the third direction of the first manipulating device 20. Therefore, the bucket safety switch 28 should be pressed if a user want to manipulate the bucket 60.

The control section 10 controls the relative bucket angle and the relative arm angle $\Theta_1$ and $\Theta_2$ to manipulate the pivot point 63 corresponding to the manipulating direction and the manipulating amount of the first manipulating device 20. The relative angles of the boom 40 and the arm 50 are as follows.

$$\dot{\Theta}_1 = \frac{\cos(\Theta_1+\Theta_2)}{l_1\sin\Theta_2} V_{2x} + \frac{\sin(\Theta_1+\Theta_2)}{l_1\sin\Theta_2} V_{2y} \quad (1)$$

$$\dot{\Theta}_2 = \left(\frac{-\cos\Theta_1}{l_2\sin\Theta_2} - \frac{\cos(\Theta_1+\Theta_2)}{l_1\sin\Theta_2}\right) V_{2x} + \left(\frac{-\sin\Theta_1}{l_2\sin\Theta_2} - \frac{\sin(\Theta_1+\Theta_2)}{l_1\sin\Theta_2}\right) V_{2y} \quad (2)$$

where $(x_1,y_1)$ represents the relative position the bucket 60 with respect to the pivot point 63, $l_1$ and $l_2$ respectively represent the lengths of the boom 40 and the arm 50, $V_2$ represents the velocity of the pivot point 63 to be determined, which has a horizontal element $V_{2x}$, and a vertical element $V_{2y}$.

If the levelling switch 92 of the switch board 90 is on, the mode is automatically set to be the automatic mode regardless of the selection of the automatic mode. In other words, the relative angle of the bucket 60 with respect to the arm 50 is controlled so that the angle of the bucket 60 can not be limited to a certain angle and can be freely determined, and is controlled so that the relative angle is maintained uniformly during the manipulation. Then, if the bucket 60 is operated by the operational signal of the third manipulating direction, the last bucket angle is reset to an absolute angle of the bucket 60 to be determined.

Preferably, a switch 29 is installed at one end of the first manipulating device 20 so that, when the levelling switch 92 of the switch board 90 is selected, the position of the bucket tip 64 is controlled in a plane having a predetermined angle set by the ground angle switch 93 of the switch board 90. Then, direction and moving velocity are determined by the manipulation along the second direction. And, then the bucket 60 is manipulated by the manipulating direction and amount if a bucket operational signal by the third manipulating direction 26 and 27 of the first manipulating device 20 is provided by a user.

Further, if the bucket angle switch 94 is selected, the bucket 60 is controlled to maintain an absolute angle.

The position $(x_2,y_2)$ of the pivot point 63 of the bucket 60 for controlling the bucket tip 64 is as follows.

$$x_2 = x_3 - l_3\cos\Theta_a$$

$$y_2 = y_3 l_3\sin\Theta_a$$

where $l_3$ represents the length of the bucket 60 and $\Theta_a$ represents the relative bucket angle with respect to the absolute horizontal plane.

The relative angles $\Theta_1$ and $\Theta_2$ of the boom 40 and the arm 50 are obtained by the above-described equations (1) and (2), using the position of the pivot point 63 of the bucket 60. And, the relative bucket angle $\Theta_3$ with respect to the arm 50 is as follows.

$$\Theta_3 = \Theta_a - \Theta_1 - \Theta_2$$

Further, an equation for uniformly maintaining the bucket angle while controlling the bucket 60 in accordance with the velocity of the bucket tip 64 is as follows. Firstly, the velocity $V_2$ of the pivot point 63 of the bucket 60 required is represented by the velocity $V_3$ of the bucket tip 64 in the following equation.

$$V_{2x} = V_{3x} + l_3\sin\Theta_a\Theta_a$$

Here $$\Theta_a = (\Theta_1 + \Theta - 2 + \Theta_3)$$

$$V_{2y} = V_{3y} - l_3\cos\Theta_a\Theta_a$$

The velocity $V_2$ of the bucket pivot point 63 obtained from the equation is converted to the angular velocities of the boom 40 and the arm 50. Further, the following equation is used as a method for determining the position of the bucket tip 64 according to manipulating directions and directions so that the angle of the bucket 60 can not be limited to a certain angle and can be freely determined. Firstly, The equation of the relationship between the angular velocities of the links and the velocity of the bucket tip 64 is as follows.

$$\begin{bmatrix} V_{3x} \\ V_{3y} \end{bmatrix} = [J] \begin{bmatrix} \dot{\Theta}_1 \\ \dot{\Theta}_2 \\ \dot{\Theta}_3 \end{bmatrix}$$

where J is as follows.

$$[J] = \begin{bmatrix} -l_1 s1 - l_2 s12 - l_3 s123 & -l_2 s12 - l_3 s123 & -l_3 s123 \\ l_1 c1 + l_2 c12 + l_3 c123 & l_2 c12 + l_3 c123 & l_3 c123 \end{bmatrix}$$

Here $$s1 = \sin\Theta_1 \quad s2 \sin\Theta_2 \quad s3 = \sin\Theta_3$$

$$s12 = \sin(\Theta_1+\Theta_2) \quad s123 = \sin(\Theta_1+\Theta_2+\Theta_3)$$

where the angular velocities $[\Theta]$ of the links are obtained in the following equation.

$$\begin{bmatrix} \dot{\Theta}_1 \\ \dot{\Theta}_2 \\ \dot{\Theta}_3 \end{bmatrix} = [J]^T \cdot [[J] \cdot [J]^T]^{-1} \cdot \begin{bmatrix} V_{3x} \\ V_{3y} \end{bmatrix}$$

Hereinafter, the above-mentioned manipulating modes for intuitional manipulation of the manipulating device will be explained.

In the first manipulating mode, the mode conversion switch 91 in the switch board 90 is converted to the automatic mode, and then the pivot point 63 of the bucket 60 is determined in proportion to the first and second manipulating directions 21, 22, 23, and 24 and their amounts, and the bucket 60 is manipulated by the bucket operational signals of the third manipulating direction 26 and 27.

In the second manipulating mode, the automatic mode 92 and the bucket angle switch 94 is selected, and then the pivot point 63 of the bucket 60 is determined in proportion to the first and second manipulating directions 21, 22, 23, and 24 and their amounts, and the bucket 60 is manipulated by the bucket operational signals of the third manipulating direction 26 and 27, while the absolute angle of the bucket is maintained uniformly.

In the third manipulating mode, the levelling switch 92 is selected, and then the tip 64 of the bucket 60 is determined in proportion to the first and second manipulating directions 21, 22, 23, and 24 and their amounts, and the bucket 60 is manipulated by the bucket operational signals of the third manipulating direction 26 and 27.

In the fourth manipulating mode, both the levelling switch 92 and the bucket angle switch 94 are selected, and then the tip 64 of the bucket 60 is determined in proportion to the first and second manipulating directions 21, 22, 23, and 24 and their amounts with the absolute angle of the bucket 60 maintained uniformly by a user, and the bucket 60 is manipulated by the bucket operational signals of the third manipulating direction 26 and 27.

In the fifth manipulating mode, the levelling switch 92 and the switch 29 of the first manipulating device 20 are selected, and then the tip 64 of the bucket 60 is controlled so that its position is determined in a plane having a predetermined angle set by the ground angle switch 93 of the switch board 90, in proportion to the first and second manipulating directions 21, 22, 23, and 24 and their amounts.

The above-mentioned five modes are displayed on the display section 95 of the switch board 90, so a user can easily recognize in which mode the excavator is operated.

The operation of the control system relevant to the pivoting body 70 and the running body 79 will be explained with reference to FIG. 1 hereinbelow.

The manipulation of the forward direction 31 of the first manipulating direction 31 and 32 of the second manipulating device 30 moves left and right chain belts 80 and 190 in the forward direction 31, and the manipulation of the rearward direction 32 moves the belts 80 and 190 in the rearward direction 32.

The manipulation of the right direction 33 of the second manipulating direction 33 and 34 of the second manipulating device 30 moves left and right chain belts 80 and 190 in the forward and rearward directions 81 and 192 respectively, thereby turning the excavator to the right, and the manipulation of the left direction 32 moves the belts 80 and 190 in the rearward and forward directions 82 and 191 respectively, thereby turning the excavator to the left.

The manipulation of the clockwise direction 36 about the X axis of the third manipulating direction 36 and 37 moves the upper pivoting body 70 in the clockwise direction 72, and the manipulation of the counterclockwise direction 37 about the X moves the upper pivoting body 70 in the counterclockwise direction 72, the velocities of the movements being in accordance with the amounts of the manipulations.

The pivot safety switch 38 prevent unintended pivoting operation during the manipulation in the first and second manipulating directions 31, 32, 33, and 34.

Figure 4:
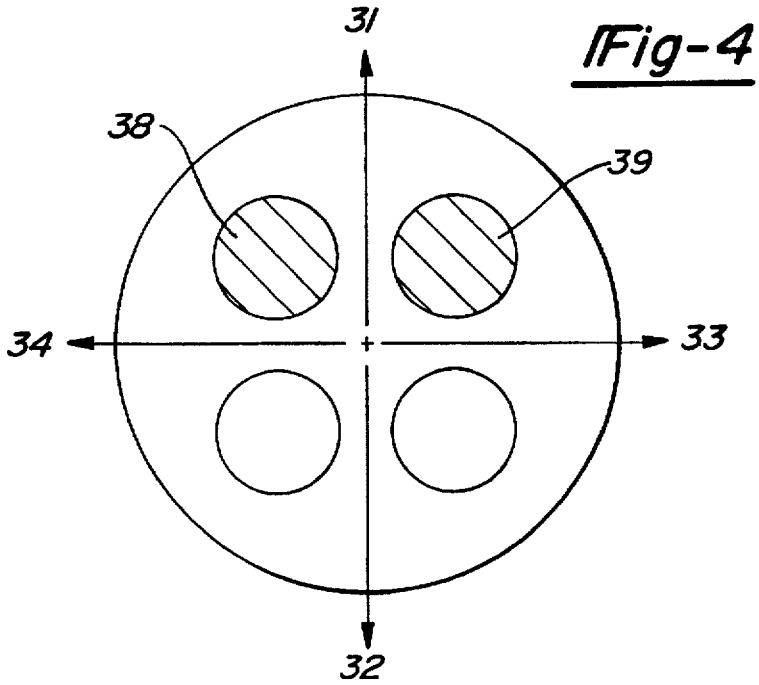
FIG. 4 is a perspective view for showing arrangements of inner sensors of a manipulating device of the control system of FIG. 1.

Preferably, if the second manipulating device is used for running operation, position detecting sensors 38 and 39 such as potentiometer, which are installed in the third manipulating direction, i.e., in the normal direction with respect to the forward and rearward direction, as shown in FIG. 4, have structures which generate a same output during the forward and rearward directional manipulation.

By the electrical signals of the second manipulating device 30 which are in charge of the running of the excavator, the chain belts 80 and 190 are controlled so that the excavator moves forward during the manipulation in the forward direction 31 if the relative angle of the upper pivoting body 70 with respect to the lower running body 79, which is detected and calculated by a pivot detecting sensor 75 and the control section 10, is above 180 degree. The chain belts 80 and 190 are also controlled so that the excavator moves rearward during the manipulation in the forward direction 31 if the relative angle of the upper pivoting body 70 is not above 180 degree. Hence, the manipulating direction of a user coincides with the moving direction of the excavator.

As above-described, the control system of the excavator according to the present invention prevents fatigues and stresses of a user by providing a pair of manipulating devices each of which can be manipulated along three directions, thereby enabling easy manipulation of the excavator along directions with two hands, i.e., in three dimensional way, and hence increases efficiency of work. The control system of an excavator is easily manipulate a working device with multi-degree of freedom, by providing intuitional controlling relation between the manipulation of a user and the operation of the excavator and by providing various operational functions, so the work efficiency of the excavator is increased.

While the present invention has been particularly shown and described with reference to a particular embodiment thereof, it will be understood by those skilled in the art that various changes in form and details may be effected therein without departing from the spirit and scope of the invention as defined by the appended claims.

What is claimed is:

1. An excavator which comprises:

a working device having a plurality of links comprising a boom attached to a tip of an upper pivoting body pivoting with respect to a lower running body, an arm attached to a tip of the boom, and a bucket attached to a tip of an arm;

a pivoting device for driving and pivoting the upper pivoting body with respect to the lower running body;

a running device for driving left and right chain belts of the lower running body;

hydraulic cylinders and hydraulic motors for actuating the working device, the pivoting device, and the running device;

hydraulic control valves for controlling quantities of hydraulic fluid supplied to the hydraulic cylinders and the hydraulic motors;

a boom angle detecting sensor installed between the upper pivoting body and the boom, for detecting a relative angular position of the boom with respect to the upper pivoting body;

an arm angle detecting sensor installed between the boom and the arm, for detecting the relative angular position with respect to the boom, a bucket angle detecting sensor installed between the boom and the bucket, for detecting the relative angular position with respect to the arm;

a control system having a pair of manipulating devices each of which can be manipulated in at least three directions so as to output electrical signals proportional to deviated amounts in selected directions among the directions from a neutral position thereof, a switch board on which a plurality of function switch are installed, for transferring a signal in accordance with a selected function and displaying the selected function, a control section for controlling quantities of hydraulic fluid supplied to the hydraulic cylinders and the hydraulic motors by receiving signals from the manipulating device, the switch board, and the angle detecting sensors and transferring the signals to the hydraulic control valves.

2. An excavator as claimed in claim 1, wherein the pair of manipulating devices are a first manipulating device installed on a vertical manipulating plane, for driving the working device in accordance with a manipulating direction and an amount thereof and a second manipulating device installed on a horizontal manipulating plane, for driving the running device and the pivoting device in accordance with a manipulating direction and an amount thereof, the vertical manipulating plane having a same direction as a direction of a working plane of the working device.

3. An excavator as claimed in claim 2, wherein the first manipulating device is manipulated in a first manipulating direction which is a first coordinate axis, in a second manipulating direction which is a second coordinate axis, and in a third manipulating direction which is a rotating direction about a third coordinate direction perpendicular to a plane formed by the first and second coordinate axes.

4. An excavator as claimed in claim 2, wherein the second manipulating device is manipulated in a first manipulating direction which is a first coordinate axis, in a second manipulating direction which is a second coordinate axis, and in a third manipulating direction which is a rotating direction about a third coordinate direction perpendicular to a plane formed by the first and second coordinate axes, the manipulating directions being respectively corresponding to a forward or rearward running operation of the running device, a left or right turning operation of the running device, and a left or right pivoting operation of the pivoting device.

5. An excavator as claimed in claim 2, wherein a pivot safety switch is installed on an outer surface of the second manipulating device so as to send a signal about the third manipulation direction of the second manipulating device when the switch is on.

6. An excavator as claimed in claim 1 further comprising:

a pivot detecting sensor installed between the upper pivoting body and the lower running body, for detecting the relative angle of the upper pivoting body with respect to the lower running body and transferring an angle signal to the control section.

7. An excavator as claimed in claim 1, wherein forward and rear movement of the lower running body is controlled so as to coincide with the first manipulating direction of the second manipulating device in accordance with whether the relative angle of the upper pivoting body with respect to the lower running body detected by the pivot detecting sensor is above 180 degree or not.

8. An excavator as claimed in claim 1, wherein a levelling switch for determining whether working ground surface should be levelled or not, a bucket angle switch for determining whether the absolute bucket angle should be maintained uniformly or not during the work, an ground angle switch for determining the inclined angle of the working surface during the levelling work, a mode conversion switch for converting the operational mode to a manual mode or an automatic mode are installed on the switch board, the switch board being provided with a display section for displaying information about operational states and modes of the excavator.

9. An excavator as claimed in claim 8, wherein in case of the manual mode, operations of the boom, the arm, and the bucket are respectively controlled by the first, second, and third manipulating directions.

10. An excavator as claimed in claim 8, wherein in case of the automatic mode, a pivot point of the bucket is determined by the first and second manipulating directions and manipulated amounts in the directions, and the bucket is manipulated by the third manipulating direction and manipulated amount.

11. An excavator as claimed in claim 9 or 10 further comprising:

a bucket selection switch installed on an outer surface of the first manipulating device, for transferring a signal to the control section about manipulated directions along the direction, and the manipulated amounts of the first manipulating device while the switch is on.

12. An excavator as claimed in claim 10, wherein when the bucket angle switch is selected during the automatic mode operation, the absolute bucket angle is uniformly maintained by manipulating the relative bucket angle with respect to the arm, and during the operation of the bucket, the bucket is manipulated regardless of the other manipulations so that the absolute bucket angle is reset to a new value.

13. An excavator as claimed in claim 8, wherein if the levelling switch is selected, the automatic mode is automatically selected, and a position of a bucket tip is determined by the first and second direction manipulation and manipulated amounts of the first manipulating device in the automatic mode, in accordance with the detected relative boom angle with respect to the upper pivoting body, the detected relative arm angle with respect to the arm, and the detected relative bucket angle with respect to the arm, the bucket being manipulated by the third manipulating direction and amount in the direction.

14. An excavator as claimed in claim 8, wherein if both the levelling switch and the bucket angle switch are selected, the position of the bucket is determined and controlled by the manipulated direction and amount in the automatic mode of the first manipulating device, and then if a signal in accordance with the third manipulating direction is transferred to the manipulating device, the bucket is manipulated regardless of the other manipulations, and then if a bucket operational signal is not transferred to the manipulating device, the absolute bucket angle is maintained uniformly.

15. An excavator as claimed in claim 2, further comprising:

a switch installed on a tip of the first manipulating device and connected to the control device, for controlling a point determined by the first manipulating direction and amount while the switch is on, so that the point is moved on a plane selected by the switch.

16. An excavator as claimed in claim 8, wherein if the switch is on during the levelling work, the bucket tip determined by directions and amounts of the first and second manipulating direction is moved in a working plane having a certain angle selected by the ground angle switch.

* * * * *